US006834793B2

(12) United States Patent
Sutherland

(10) Patent No.: US 6,834,793 B2
(45) Date of Patent: Dec. 28, 2004

(54) ENCLOSED CONTAINER CARTON CONVERTIBLE INTO A TRAY

(75) Inventor: Robert L. Sutherland, Kennesaw, GA (US)

(73) Assignee: Graphic Packaging International, Inc., Marietta, GA (US)

( * ) Notice: Subject to any disclaimer, the term of this patent is extended or adjusted under 35 U.S.C. 154(b) by 16 days.

(21) Appl. No.: 10/449,056

(22) Filed: May 31, 2003

(65) Prior Publication Data

US 2004/0238611 A1 Dec. 2, 2004

(51) Int. Cl.[7] ..... B65D 17/00
(52) U.S. Cl. ..... 229/227; 229/146; 229/117.13
(58) Field of Search ..... 229/146, 121, 229/122, 117.14, 117.13, 224, 225, 226, 227, 228, 235

(56) References Cited

U.S. PATENT DOCUMENTS 2,887,389 A * 5/1959 Linville ..... 426/124
2,964,231 A * 12/1960 Hanselman, Jr. et al. ... 206/264
2,990,992 A * 7/1961 Ellis ..... 229/121
3,164,316 A * 1/1965 Wurster et al. ..... 229/228
3,181,772 A * 5/1965 Collins et al. ..... 229/117.13
3,185,382 A * 5/1965 Nunn ..... 229/246
3,206,096 A * 9/1965 Struble ..... 206/324
3,596,823 A * 8/1971 Zitzelman ..... 229/121
3,693,865 A * 9/1972 Desmond et al. ..... 229/121
4,271,964 A * 6/1981 Train ..... 229/208
4,944,407 A * 7/1990 Thiele et al. ..... 229/123.1

* cited by examiner

*Primary Examiner*—Tri M. Mai
(74) *Attorney, Agent, or Firm*—Womber Carlyle Sandridge & Rice, PLLC

(57) ABSTRACT

An enclosed carton for carrying a number of containers, such as cans, which is easily convertible into a tray with a lid, from which the cans can be easily removed. The tray is formed by a zipper with two tear lines that are formed in the adjoining bottom flaps of the carton. The carton may have a carrying handle for carrying the carton loaded with containers. This carton is especially designed to be easily convertible into a tray for holding cans between two closely spaced shelves in a refrigerator. Provision is made for the easy removal of the lid. Another embodiment of this invention discloses an enclosed carton with diamond shaped corners so that the carton can be tightly packed and which is also convertible into a tray.

30 Claims, 4 Drawing Sheets

ENCLOSED CONTAINER CARTON CONVERTIBLE INTO A TRAY

BACKGROUND OF THE INVENTION

1. Field of the Invention

The present invention relates generally to an enclosed paperboard carton capable of enclosing a number of containers, such as cans, which can be easily converted into a tray from which the containers can be removed one at a time with the other containers in the tray not being disturbed. This carton is provided with a zipper-like tear strip and an aperture into which a person may insert his or her finger to commence tearing the tear strip open. This tear strip is located where the bottom flaps in the carton overlap and is designed to be opened while the carton is resting on a side panel on which the ends of the containers have been placed. Once the tear strip has been opened, a lid is formed which can be opened and closed with a fold line in the top panel functioning as a hinge. The opening of the lid is not impeded because of the design of the ends of the carton.

A tear line can be provided in the top panel so that the lid can be completely removed from the tray. These same features can be incorporated in an enclosed carton for containing cylindrical containers, such as cans, which is designed to provide a tighter package by placing a diamond shaped corner panel formed by fold lines, between each bottom end flap and the bottom panel.

2. Background

Fully enclosed cartons capable of enclosing cylindrical containers, such as cans, have been used in the past that have a feature for dispensing the cans one at a time. Dispenser sections have been provided at various locations and with various features within these cartons depending on the design.

Trays constructed of different materials, such as plastic and corrugated paperboard, have been used in the past. These trays have sometimes been wrapped in shrink film to prevent the containers from falling out while the tray is being carried. Once the shrink film has been removed, these trays provide a convenient dispenser from which containers can be pulled one at a time. These trays are difficult to carry because they do not have a built-in carrying handle and it may be difficult to remove the plastic film from the tray to access the cans contained in the tray.

SUMMARY OF THE INVENTION

It is an object of this invention to provide a fully enclosed carton for carrying containers, such as cans, that can easily be converted into a tray for holding the containers which can be easily pulled from the tray one at a time without disturbing the other containers. It is a further object to provide a fully enclosed carton that can be converted into a tray that will easily fit between two closely spaced shelves in a refrigerator. It is a further object to provide a tray that has a lid that can be opened and closed. It is another object of this invention to provide an enclosed carton where the lid can be completely torn off and discarded. It is a still further object of this invention to provide an enclosed carton that can easily be converted into a tray by providing an easy opening feature for the carton. Another object is to provide a fully enclosed carton where the ends are closed but permit the top portion of each end of the carton being easily removed along with the rest of the lid.

It is still a further object of this invention to provide an enclosed carton that is easily convertible into a tray with both the enclosed carton and the converted tray being structurally sound to serve their function reliably. It is a further object of this invention to provide an enclosed carton that can be converted into a tray which has a handle for carrying the carton.

It is a further object of this invention to develop an enclosed carton in which cylindrical containers, such as cans, can be tightly packed with little wasted space, and still be converted into a tray that also satisfies the objects stated above.

The objects of this invention have been achieved by providing an enclosed carton for containing a number of containers, such as cans, that is easily convertible into a tray for dispensing the containers. This carton has a top panel, two side panels and a bottom panel formed from two bottom flaps which overlap a short distance. The carton has a co-extensive tear strip in the overlapped portion of the bottom flaps with a portion of the co-extensive tear strip being provided in each bottom flap so the co-extensive tear strip can be torn open across the bottom panel. A finger aperture may be provided to make the commencing of the tearing of the co-extensive tear strip easier.

Each end of the carton is closed by folding the bottom end flaps and top end flap inwardly and folding the side end flap attached to each side panel over the bottom end flaps and top end flap and gluing the side end flaps thereto. In order to convert this carton into a tray the side end flaps only abut each other or have slight overlap and are not glued to each other. The side end flaps are only glued to the bottom and top end flaps and not to each other. A cut or tear line may be provided in each bottom end flap that extends from the co-extensive tear strip to facilitate dividing the end of the carton into a lower tray and upper lid. Since the side end flaps on each end of the carton are not glued to each other, they are easily separated when converting the carton into a tray. A fold line may be provided that extends the length of the top panel about which the lid is hinged. A tear line may be extended from the top panel into the each top end panel to facilitate converting the carton into a tray so the lid can be torn completely from the carton.

This carton may have a handle in the top panel for carrying. A slotted handle is preferred, although other types of handles may be used. The consumer can carry this carton home in the same way in which many twelve pack cartons are carried. After getting home, the lid of the carton can be opened or torn off and the tray placed between two closely spaced shelves in a refrigerator from which a container, such as a can, can be pulled without the disturbing the other containers in the tray.

Preferably the bottom flaps are secured together by glue to form the bottom panel and the side end flaps are glued to the bottom and top end flaps to seal each end of the carton. An aperture may be provided for commencing the tearing of the co-extensive tear strip which can be located between the tear lines forming the co-extensive tear strip. A portion of the bottom end flap that will remain as a part of the tray can be allowed to extend above the tear line that defines the upper edge of the tray so that this portion of the bottom end flap serves as a guide flap over which the side panel on the lid on the same end of the tray can be guided into proper position for closing the lid. A smaller aperture adjacent to tear strip on the other end of the carton serves to permit the tear strip to be completely removed from the carton. A guide flap can also be provided on this end of the tray for guiding the lid back into the closed position.

This carton can be formed with the lid having a greater depth than the tray to make it easier to remove a container from the tray when placed between two closely spaced shelves in a refrigerator or pantry.

This carton may be provided with a tear line for removing the lid that extends from the end of the top end flap through its center and into the top panel and extends at an angle to a fold line between a side panel and the top panel. This tear line may extend along what otherwise would be the fold line between the top panel and the side panel and then turn into the top panel in the same way that it is placed on the other end of the carton and extend up to the center fold line and through the top end flap.

An enclosed carton for carrying cylindrical containers, such as cans, can be designed with the feature discussed above, but which permit the carton to be more tightly packed. This is achieved by basically placing a diamond shaped panel in each corner of the carton so this diamond shaped panel more closely follows the cylindrical surface of the adjoining can and eliminates the empty square corners in the carton. Explained in more detail, the diamond shaped panel in each corner of the carton is formed by a pair of triangular panels that diverge away from each corner. For example, a triangular panel that diverges away from a corner formed by the intersection of the top panel, adjacent top end flap, and adjacent side panel meets an identical triangular panel formed in the corner with the opposite side panel. A pair of triangular panels meet each other near the center of the top panel between the top panel and the top end flap on each end of the carton.

A pair of triangular panels that diverge away from a corner is formed between each end of the bottom panel and the bottom end flap and adjoining side panel of the same configuration as each pair of triangular panels formed between the top panel and top end flap.

The enclosed carton with diamond shaped corners also has a tear strip in the portion of the bottom end flaps that overlap to form the bottom panel. Because of the presence of the pair of triangular panels on each end of the bottom panel, the tear strip extends through a triangular panel on each end of the bottom panel into the adjoining bottom end flap. A pair of tear lines may be extended into a side end flap that forms a part of the lid of the tray to facilitate opening the lid of the carton. An aperture may be provided in the side end flap between these tear lines extending into the adjoining bottom end flap to commence opening the tear strip.

The carton with the diamond shaped corners may be provided with a tear line for removing the lid that extends from the end of the top end flap through its center and through the diamond shaped panel and into the top panel and extends at an angle to a fold line between a side panel and the top panel. This tear line may extend along what otherwise would be the fold line between the top panel and the side panel and then turn into the top panel in the same way that it is placed on the other end of carton and extend up to the center fold line through the diamond shaped panel and the top end flap.

It is readily apparent that either of the side panels could serve as the bottom panel of the tray and the other side panel be torn away as the lid in either of these embodiments.

This carton can be constructed by gluing, taping, stapling and the like, or by locking. It is preferred that this carton be glued. These and other objects, features, and advantages of he present invention will become more apparent upon reading the following specification in conjunction with the accompanying drawing figures.

DETAILED DESCRIPTION OF THE PREFERRED EMBODIMENT

The present invention is intended primarily for the use in carrying cylindrical containers, such as cans, of the types used to contained soft drinks, beer and the like. The enclosed carton of this invention can be used for carrying containers, such as cans, utilizing a convenient carrying handle. When it is desired to open the carton to dispense the cans, the carton can be easily converted into a tray to which a lid may remain attached or removed depending on the circumstances. This tray with the cans fully exposed for easy removal can be placed on a refrigerator shelf that is closely spaced to the shelf immediately above it. A can may be easily removed from the tray without disturbing the other cans in the tray.

In one embodiment of this invention, the carton is constructed with square corners and can be used both for containing cylindrical containers, such as cans, or containers with square or rectangular shaped cross sections.

Another embodiment of this invention has rounded, or diamond shaped, corners which is specifically designed to carry cylindrical containers, such as cans. This carton with rounded corners can be more tightly packed as the rounded corners can be fitted tightly against the cylindrical surfaces of each can in a corner of the carton.

1. Carton with Square Corners that is Convertible into a Tray

Figure 1:
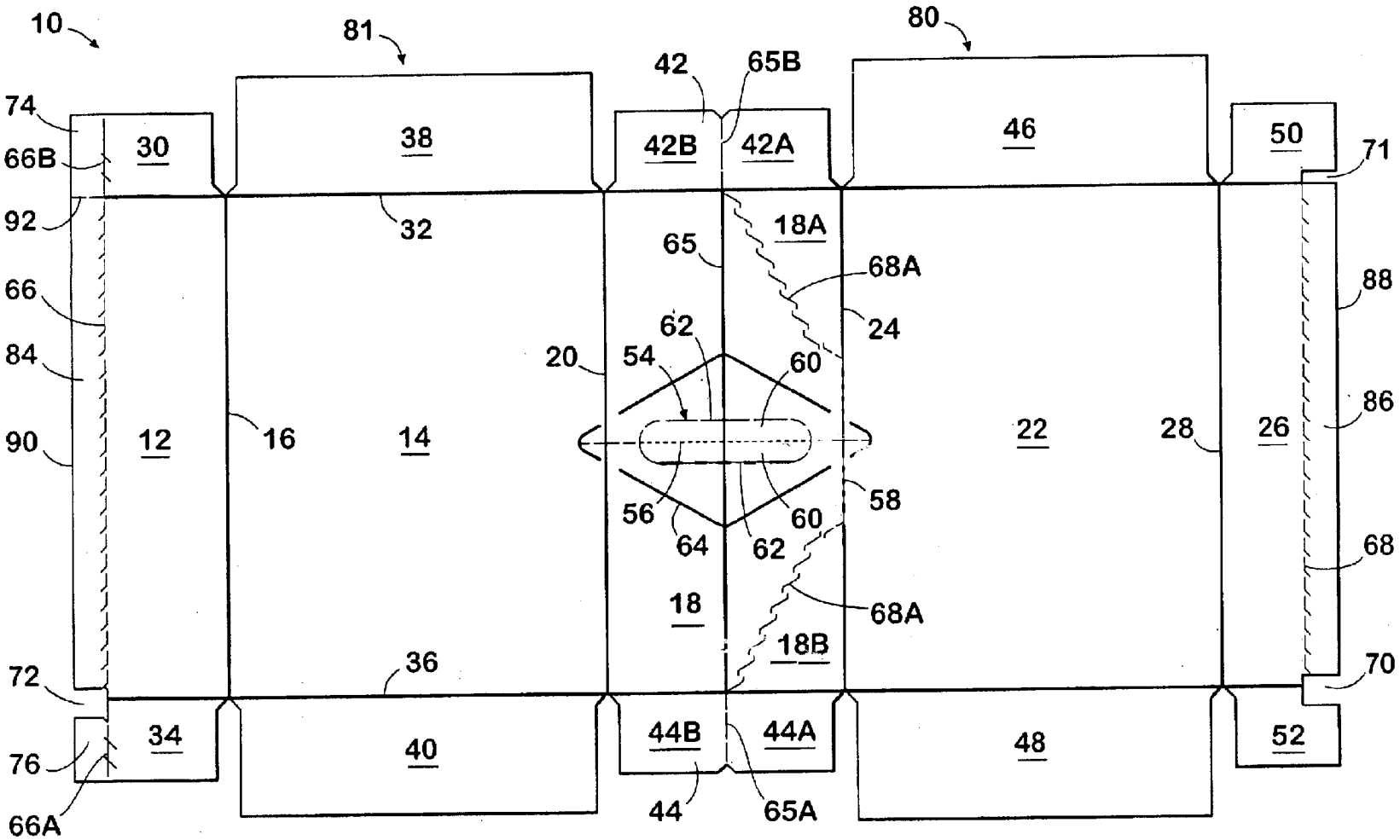
FIG. 1 is a plan view of a blank from which a carton according to one embodiment of this invention is formed.
Figure 2:
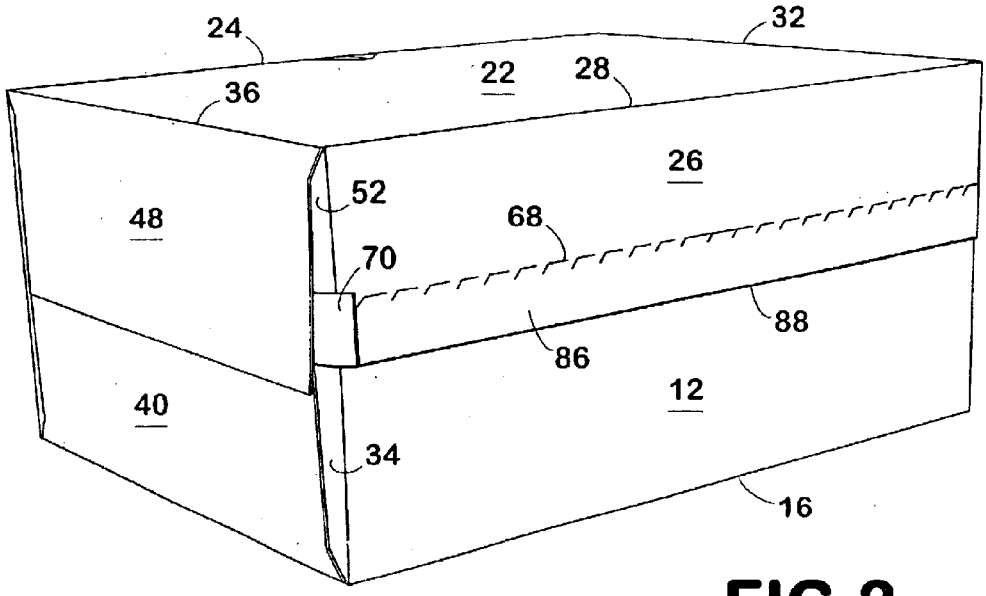
FIG. 2 is a perspective view of the carton formed from the blank of FIG. 1 and loaded with cans which shows the co-extensive tear strip for converting this carton into a tray.

The blank for making a convertible carton with square corners is illustrated in FIG. 1. This blank 10 is formed from a foldably sheet of material, such as paperboard. This blank 10 has a bottom flap 12 which is foldably attached to bottom side panel 14 by fold line 16 and in turn attached to top panel 18 by fold line 20. Top panel 18 is foldably attached to top side panel 22 by fold line 24 and in turn attached to bottom flap 26 by fold line 28. Bottom flap 12 is foldably attached to bottom end flap 30 by fold line 32 and to bottom end flap 34 by fold line 36. Bottom side panel 14 is foldably attached to side end flap 38 by fold line 32 and to side end flap 40 by fold line 36. Top end flap 42 is attached to top panel 18 by fold line 32 and top end flap 44 is attached to top panel 18 by fold line 36. The top side panel 22 is foldably attached to side end flap 46 by fold line 32 and to side end flap 48 by fold line 36. Bottom flap 26 is foldably attached to bottom end flap 50 by fold line 32 and to bottom end flap 52 by fold line 36.

It will be understood by those skilled in the art that the carton of the present invention is generally symmetrical about a horizontal line of bisection, as viewed when FIG. 1 is rotated lengthwise. This symmetry aids in the efficient production of the present carton.

This carton may have a handle for carrying the loaded carton. A slotted handle 54 is shown in FIG. 1. The slotted handle 54 is formed by placing a tear line 56 which is normal to fold lines 20 and 24. This tear line 56 separates two handle flaps 60 that are attached to the top panel 18 by fold lines 62. Tear line 56 may be extended completely across top panel 18 and may be extended into side panels 14 and 22 to dissipate the stress imposed on the top panel 18 in carrying the carton. A diamond shaped stress relief line 64 may be placed around the slotted handle to help in dissipating the stress imposed in carrying this carton. It should be realized that other types of handles, such as the "race track" type of handle or a handle formed from two finger apertures can be used. Of course, this carton can be constructed without any handle. A person carries a carton with this slotted handle 54 by pushing his or her fingers through tear line 56. Handle flaps 60 cushion a person's hand when carrying the carton by the handle.

This blank 10 is formed into a sleeve into which containers, such as cans, may be loaded. This sleeve is formed by folding the blank along fold lines 16, 20, 24, and 28. Bottom flaps 12 and 26 are glued together to form a bottom panel by gluing tear strip 84 to tear strip 86 in an overlapping position, resulting in forming a co-extensive tear strip which is a two layer combination of tear strips 84 and 86. It is preferred that tear strip 86 overlap tear strip 84.

The carton sleeve can then be loaded with containers, such as cans whose bottom ends rest on bottom side panel 14.

The ends of the carton can then be folded to close each end and secure it together, preferable by glue. Both ends of the carton are closed in the same manner. Top end flap 44 on one end of the carton is folded inwardly along with bottom end flaps 34 and 52. Side end flap 40 is folded inwardly and glued to lower top end flap 44B and bottom end flap 34. Side end flap 48 is folded over and glued to upper top end flap 44A and bottom end flap 52. For ease in converting this carton into a tray it is preferred that side end flaps 40 and 48 are not glued to each other. It is preferred that they abut each other or slightly overlap to facilitate forming this carton into a tray.

Similarly on the other end of the carton top end flap 42 and bottom end flaps 30 and 50 are folded inwardly. Side end flap 46 is folded and glued to upper top end flap 42A and bottom end flap 50. Side end flap 38 is folded and glued to bottom end flap 30 and lower top end flap 42B. It is preferred that side end flaps 38 and 46 not be glued to each other and only abut or slightly overlap.

It should be realized that this carton can be constructed by gluing, taping, stapling and the like, or by locking it. It is preferred that this carton and the carton with the diamond shaped corners discussed infra be glued.

This carton loaded with cans can be carried home by the consumer and easily converted into a tray. Conversion can be easily done by resting the carton on bottom side panel 14. It will be noticed that finger aperture 70 is preferably formed between tear strip 86 and bottom end flap 52 and finger aperture 72 is preferably formed between tear strips 84 and bottom end flap 34 as illustrated in FIG. 1. This co-extensive tear strip formed from tear strips 84 and 86 can be easily torn open because the individual tear strips 84 and 86 are glued together so they overlap each other to form the co-extensive tear strip. This overlap results in tear opening line 66 being immediately adjacent to the edge 88 of tear strip 86 and tear opening line 68 of tear strip 86 being immediately adjacent to edge 90 of tear strip 84. Overlapping these tear strips 84 and 86 at the end of bottom flaps 12 and 26 makes the co-extensive tear strip easy to open as it is only necessary to tear open tear opening lines 66 and 68. The carton is not weakened by this placement of the tear lines because of the overlapping of tear strips 84 and 86 to build the stronger structure of a co-extensive tear strip.

This co-extensive tear strip composed of tear strips 84 and 86 is opened by a person inserting his or her finger into co-extensive finger apertures 70 and 72 and tearing the co-extensive tear strip open. An aperture 71 may be provided at the other end of tear strip 86 and a cut line 92 at the other end of tear strip 84 to facilitate the removal of co-extensive tear strip.

The ends of the carton of this embodiment of the invention has been provided with several features to facilitate forming the carton into a tray. In the first place, side end flaps 40 and 48 are not glued together which would present a formidable obstacle in tearing the ends of the carton to form the tray. Preferably side end flaps 40 and 48 abut each other are or only overlapped a small distance so that the carton not only appears to be, but is in fact fully enclosed. These same features are present between side end flaps 38 and 46 on the other end of the carton.

Guide flap 76 is preferably not glued to bottom end flap 52. Guide flap 76 guides the closing of lid 80 if it is left attached to the carton. Otherwise, guide flap 76 can be glued to bottom end flap 52 and tear opening line 66A provided to permit the conversion into a tray 81 without any protrusion above the top of the tray 81. Guide flap 76 is obviously not needed if the lid 80 is removed. Likewise, side end flap 46 is preferably only glued to bottom end flap 50. Guide flap 74 is preferably not glued to bottom end flap 50, so guide flap 74 can serve as a guide when it is desired to have a closeable lid 80. Otherwise, guide flap 74 can be glued to bottom end flap 50 and tear opening line 66B provided to permit the conversion into a tray 81 without any protrusion above the top of the tray 81. Guide flap 74 is not needed if the lid is removed.

Figure 3:
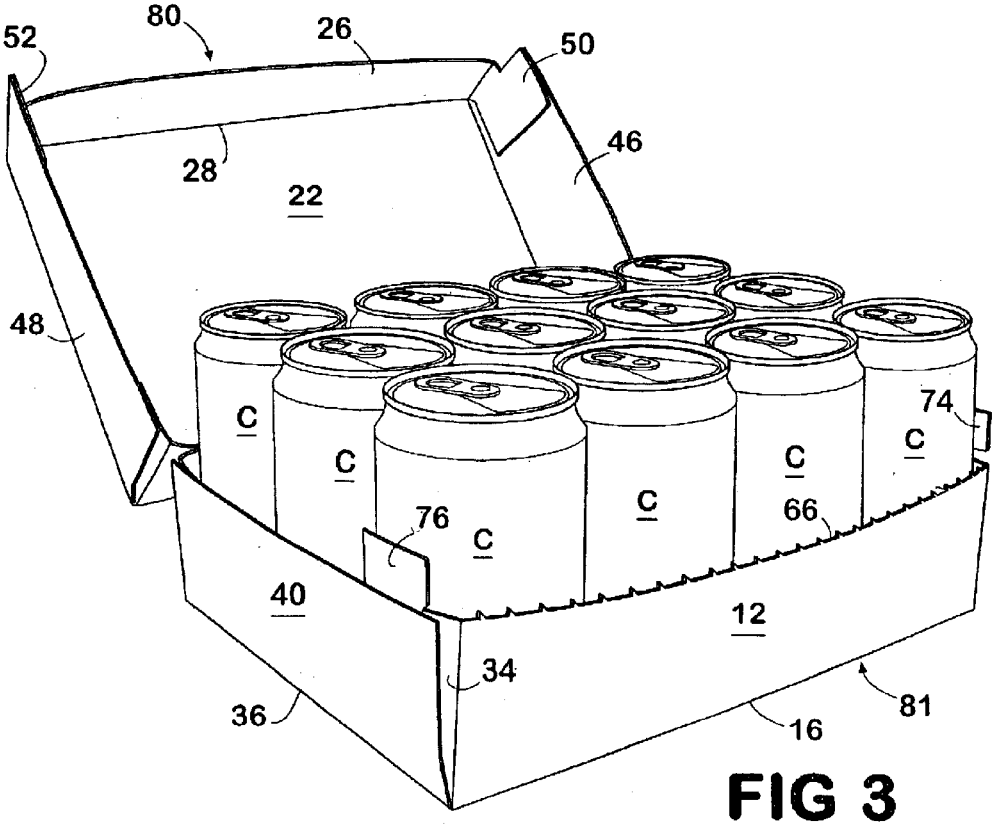
FIG. 3 is a perspective view of the carton of FIG. 2 which has been formed into a tray containing the cans with the lid to the tray remaining attached.

A fold line 65 is provided in top panel 18 which extends from top end flap 42 to top end flap 44. The lid 80 as illustrated in FIG. 3 is hinged along fold line 65. Tear lines 65A and 65B may be formed as extensions of fold line 65 which will facilitate opening the ends of the carton to form a tray with or without a lid 80.

As the lid 80 of this carton is hinged along fold line 65 the lid can remain attached to the carton and reclosed. Guide flaps 74 and 76 extend above tear opening line 66 as illustrated in FIG. 3. These guide flaps 74 and 76 facilitate closing the lid 80 over the tray 81. Finger apertures 70 and 72 are provided for commencing the tearing of the co-extensive tear strip formed by the gluing of tear strips 84 and 86 together. It is preferred that tear strip 86 overlap tear strip 84. In order to have uniformity in the tray 81 it is important that side end flaps 38 and 40 be of the same height or depth. It will be noticed that guide flaps 74 and 76 can be removed by providing tear lines 66A and 66B which are basically extensions of tear like 66.

The lid 80 can be removed from the tray 81 by providing step tear line 68A which extends from tear line 65A at an angle through top panel 18 to fold line 24 which is formed as a tear line 58 until it reaches step tear line 68A which extends at an angle through top panel 18 until it reaches tear line 65B. The lid 80 can be removed by tearing step tear lines 68A and tear line 58. The commencing of the tearing can be started by tearing of step tear lines 68A either near top end flap 42 or 44. It will be noticed that portions of the top panel 18A and 18B will be removed when the lid 80 is removed. If desired the remaining portion of top panel 18 can be folded along 65 so that fold line 65 is at the same distance from the bottom side panel 14 as the top edges of side end flaps 38, 40 and bottom flap 12.

The enclosed carton of this embodiment that is convertible into a tray 81 can be used for various types of containers. It is especially useful for cylindrical containers and cans.

2. A Carton with Diamond Shaped Corners that is Convertible into a Tray

This carton can also be converted into a tray in much the same manner as the embodiment described above. The most important difference between this embodiment and the embodiment described above is that the carton of this embodiment has diamond shaped corners.

Figure 4:
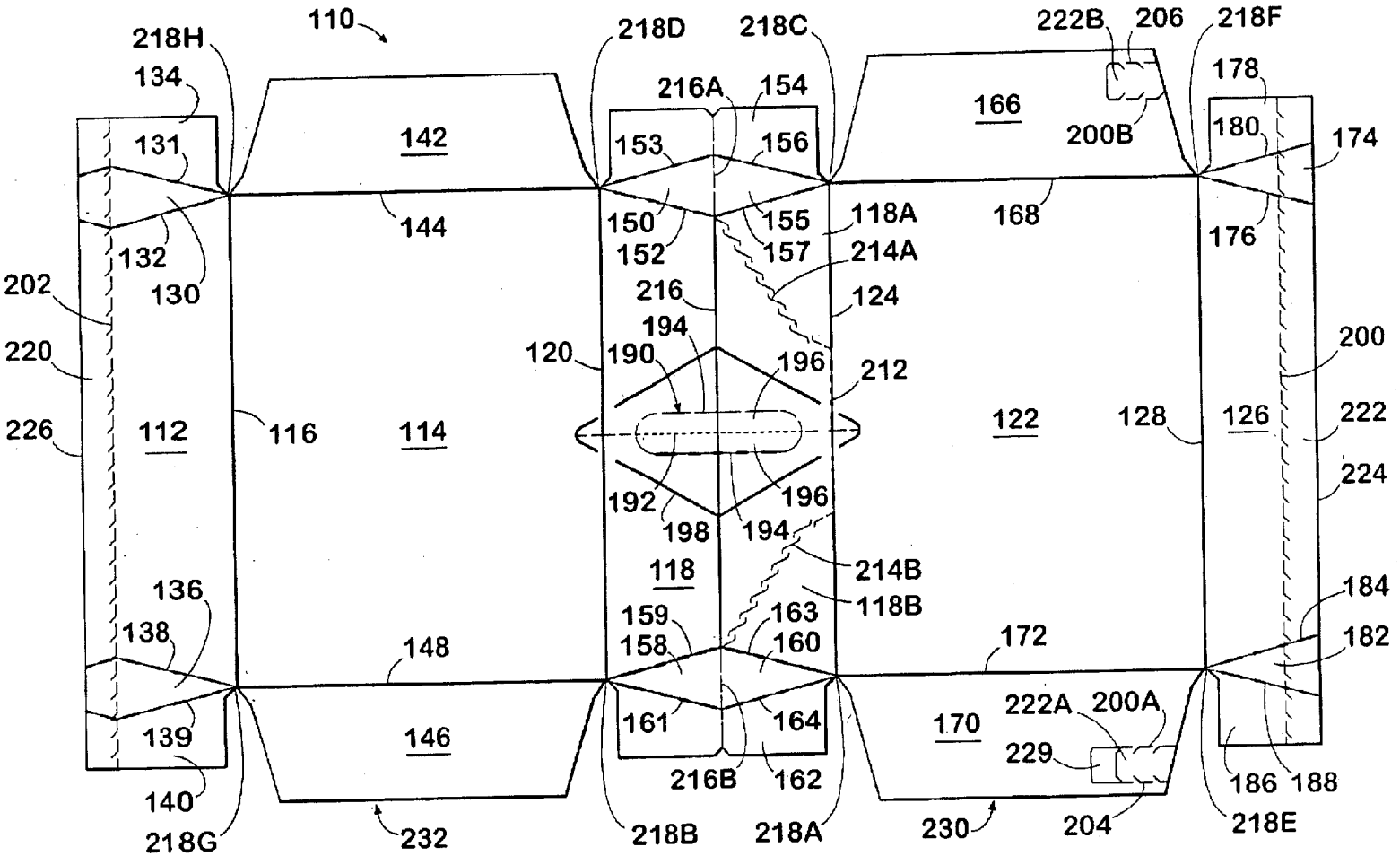
FIG. 4 is a plan view of a blank for another embodiment of this invention from which a carton is formed that can be converted into a tray with the carton having diamond shaped corners.
Figure 5:
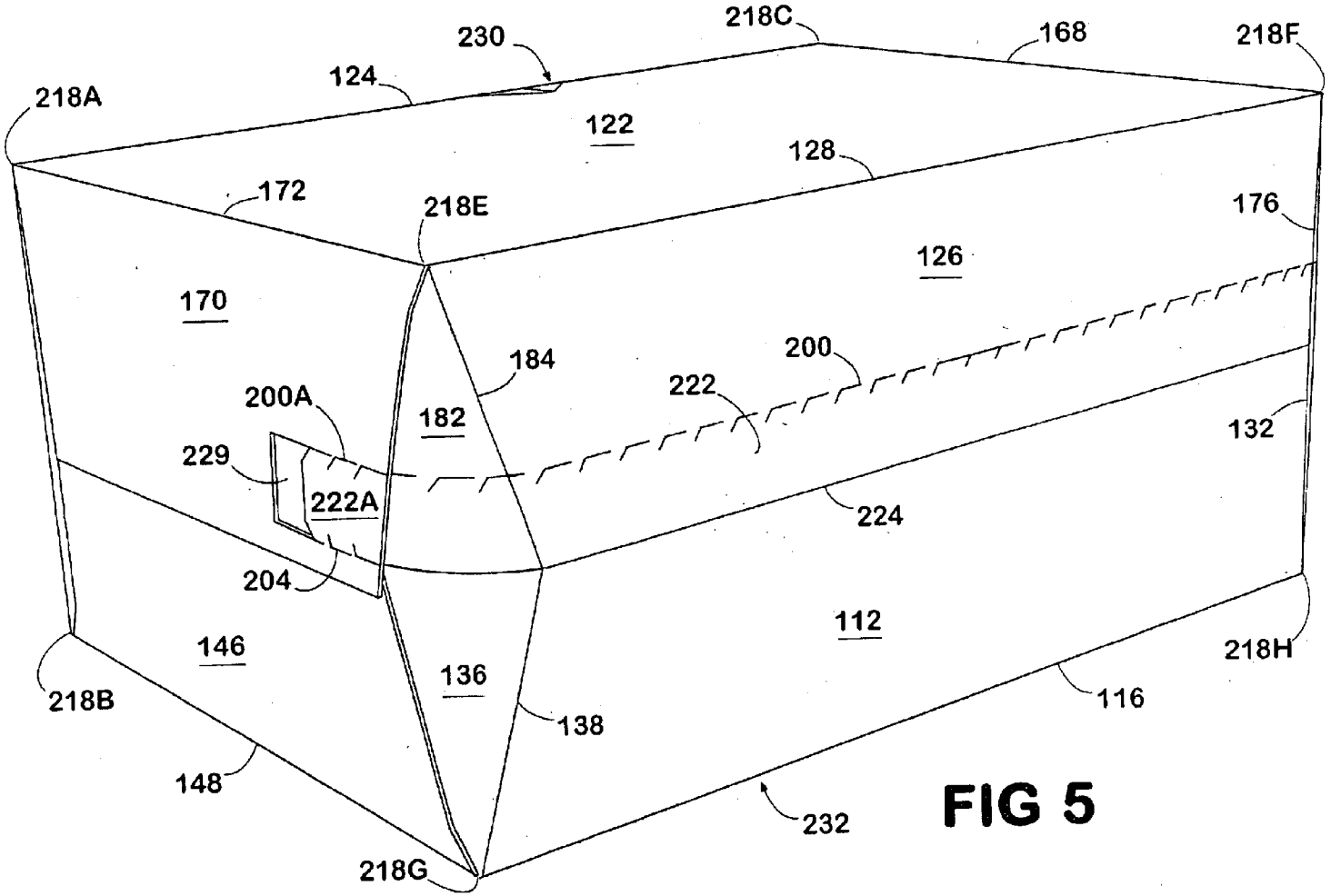
FIG. 5 is a perspective view of the carton formed from the blank of FIG. 4 and loaded with cans which show the co-extensive tear strip for converting this carton into a tray.

This blank 110 is formed from a foldably sheet of material, such as paperboard as shown in FIG. 4. This blank has a bottom flap 112 that is connected to bottom side panel 114 by fold line 116 and in turn connected to top panel 118 by fold line 120, which in turn is connected to side panel 122 by fold line 124 and finally to bottom flap 126 by fold line 128.

Side end flap 142 is connected to bottom side panel 114 by fold line 144. Side end flap 146 is connected to bottom side panel 114 by fold line 148. Side end flap 166 is connected to top side panel 122 by fold line 168. Side end flap 170 is connected to top side panel 122 by fold line 172.

A principal difference between this embodiment and the embodiment described above is the presence of diamond shaped panels in each corner of the carton. The diamond shaped panels are basically formed by joining two triangular panels together at a co-extensive base. A triangular panel 130 is formed in bottom flap 112 by fold lines 131 and 132. A similar triangular panel 136 is formed in bottom flap 112 by fold lines 138 and 139. The remainder of the triangular panels necessary to form the diamond shaped panels are formed in bottom flap 126. Most of triangular panel 174 is formed by fold lines 176 and 180 in bottom flap 126. Most of triangular panel 182 is formed in bottom flap 126 by fold lines 184 and 188. A small portion of triangular panels 174 and 182 is formed in tear strip 220 in bottom flap 112. When bottom flaps 126 and 112 are folded together and tear strips 220 and 222 are glued together, triangular panels 174 and 130 join to complete a diamond shaped corner. Similarly, triangular panels 136 and 182 join to form a diamond shaped corner.

A pair of triangular panels 150 and 155 is formed in top panel 118 by fold lines 152, 153, 156 and 157 to form a diamond shaped panel. A corresponding diamond shaped panel is formed on the other end of the carton by triangular panels 158 and 160 by fold lines 159, 161, 163 and 164.

Each of these triangular panels 130, 136, 150, 155, 158, 160, 174 and 182 is formed by fold lines that commence at a corner of a panel and diverge away from each other. For example, triangular corner panel 150 is formed by fold lines 152 and 153 that diverge away from corner 218D that is formed between the intersection of bottom side panel 114, top panel 118 and top end flap 154.

In a similar manner, corner 218A is at the intersection of top panel 118, top side panel 122 and top end flap 162. Corners 218A–H are illustrated in FIG. 4. A triangular panel commences at each corner 218A–H. The lines of these triangular panels diverge away from each other as illustrated by fold lines 152 and 153 until they meet fold lines 156 and 157 of triangular panel 155. The purpose of these triangular panels 218A–H is to permit a tighter package to be formed for containing cylindrical containers, such as cans, which will be explained in more detail infra.

As in the case of the embodiment discussed supra, this carton also has a slotted handle 190 which is formed by tear line 192 which may extend into side walls 114 and 122 to dissipate the stress placed upon the handle. Handle flaps 196 are separated by tear line 192 with the handle flaps being foldably attached to the top panel by fold lines 194. A diamond shaped stress relief line 198 can be used to assist in distributing the stress imposed on the top panel in carrying the carton loaded with cans.

The blank shown in FIG. 4 is formed into a carton sleeve by folding the blank along lines 116, 120, 124, and 128 to form a carton sleeve with tear strips 220 and 222 glued together. These tear strips 220 and 222 are formed by tear opening lines 200 and 202. Each of these tear strips 220 and 222 extend through triangular panel 130 and bottom end flap 134 and triangular panel 136 and bottom end flap 140 and triangular panel 174 and bottom end flap 178 and triangular panel 182 and bottom end flap 186 respectively as shown in FIG. 4.

In gluing tear strip 220 to tear strip 222 the edge 224 of tear strip 222 is placed adjacent to tear opening line 202 while the edge 226 of the tear strip 220 is placed adjacent to tear opening line 200. This results in forming co-extensive tear strip formed from tear strips 220 and 222. Preferably, tear strip 222 is overlapped and glued to tear strip 220.

Cans can be loaded into the carton sleeve, in this case twelve cans, and both ends of the carton closed. One end of the carton can be closed by folding top end flap 154 inwardly and folding bottom end flaps 178 and 134 inwardly. Side end flaps 142 and 166 are then folded and glued to bottom end flaps 134 and 178 respectively, and top end flap 154. As in the case of the embodiment discussed above, the side end flaps 142 and 166 abut each other or may slightly overlap, but are not glued to each other. This facilitates opening the end of the carton when the co-extensive tear strip formed from tear strips 220 and 222 is torn open.

The other end of the carton is closed in the same manner with top end flap 162 and bottom end flaps 140 and 186 being folded inwardly to which side end flaps 146 and 170 are glued respectively.

The closing of the ends of this carton sleeve results in the pairs of triangular panels 130 and 174, and 150 and 155, and 136 and 182, and 158 and 160 being folded inwardly and curved against the cylindrical side of a can adjacent the corner 218A–H at which the triangular panel has lines that diverge away from the corner. This results in a tightly packed carton, as there is no empty space as in the case of square corners used with cylindrical containers.

The carton can be carried by the slotted handle 190 as in the case of the embodiment described supra. Tear strip 222 extends into bottom end flap 178 and into side end flap 166 and into bottom end flap 186 and into side end flap 170 respectively as tear strips 222B and 222A. Tear line 200 is extended through bottom end flaps 178 and 188 into side end panels 166 and 170 as tear line 200B and 200A respectively. Tear lines 204 and 206 in side end flaps 170 and 166, respectively, are basically extensions of the edge 224 of bottom flap 126. A finger aperture 229 is provided in side end flap 170 so the tear strip 222A, 222, and 222B can be removed along with tear strip 220 which are glued together and form a co-extensive tear strip. Tear strip 222A extends into side end flap 170 a distance approximately equal into the length of bottom end flap 186 to facilitate opening the lid 230. Tear line 200B and 206 extend to side end flap 166 a distance approximately equal to the length of bottom end flap 178 to facilitate opening the lid 230. The lid 230 may be folded along top fold line 216 to open the tray 232 for the removal of cans. Tear lines 216A and 216B will tear so the lid 230 can be opened.

Lid 230 can be removed from the tray 232 by tearing tear line 216A that extends through top end flap 154 and the co-extensive base between triangular panels 150 and 155 until it joins top fold line 216. On the other end of the carton tear line 216B extends through top end flap 162 and the co-extensive base between triangular panels 158 and 160 until it meets top fold line 216. Tear line 216A connects with step tear line 214A which extends at an angle through a portion of top panel 118 until it reaches fold line 124 and extends along this line as dispenser tear line 212 until it meets step tear line 214B which angles towards top fold line 216 and joins tear line 216B. Tearing tear lines 216A, 214A, 212, 214B and 216B and the co-extensive tear strip formed from tear strips 220 and 222 will permit the removal of the lid of the carton 230. Portions of the top pane 118A and 118B will be removed as part of the lid 230. The remaining portion of the top panel 118 can be folded along fold line 216 to make the edges of the tray of a uniform height.

The tray formed from this carton can be opened by tearing co-extensive tear strip 228 and putting the tray 232 with the lid 230 on a refrigerator shelf or other shelf. In many cases it is preferable to remove the lid 230.

The arrangement shown in FIG. 4 is designed to carry twelve cans, but it should be realized that different multiples of cans, or other cylindrical containers, may be carried depending upon the size of the can and the size of the carton.

Unique Features of this Carton

The convertible carton of this invention is especially unique in that the carton can be packed with cans at the bottling plant, shipped to the store and carried home by the consumer using a carrying handle in the conventional fashion, but when at home the carton can easily be converted into a tray. This tray will fit on a refrigerator shelf between two closely spaced shelves. The carton is easily opened by a unique zipper but is strengthened by having two layers of overlapping paperboard, but yet can be tom off with a single tear line on each side of the zipper.

While the ends of this carton are fully enclosed, each end is also designed to be easily divided into a part of the tray or lid. This is accomplished by not gluing the side end flaps together so they do not have to be torn as part of the conversion process into a tray. The lid for this tray can be left attached at one end and reclosed or torn off completely.

Another embodiment of this invention that can be converted into a tray uses diamond shaped corners which results in a carton that is more tightly packed with cans.

While the invention has been disclosed in its preferred forms, it will be apparent to those skilled in the art that many modifications, additions, and deletions can be made therein without departing from the spirit and scope of the invention and its equivalents as set forth in the following claims.

Therefore, having thus described the invention, at least the following is claimed:

1. An enclosed carton for containing a plurality of containers that is easily convertible into a tray with a hinged lid for dispensing the containers, said carton comprising:

(a) a top panel attached to two side panels, a bottom flap attached to each side panel by a fold line, each bottom flap having an edge which is at least substantially parallel to said fold line, one bottom flap overlapping the other bottom flap with means to secure said bottom flaps together to form a bottom panel;

(b) the carton having two ends, with each end being closed by a top end flap foldably attached to said top panel, a bottom end flap foldably attached to each bottom flap forming said bottom panel, a side end flap foldably attached to each side panel, with said side end flaps being secured to said adjacent top end and adjacent bottom end flaps by securing means when said end is closed, with no more than a small overlap of one side end flap over the other side end flap;

(c) said carton having a co-extensive tear strip in said bottom panel comprising an edge portion of said bottom and between a tear line in each bottom flap, said tear strip extending from one bottom end flap to the other bottom end flap, said tear lines being at least substantially parallel to each other and spaced apart from each other to form a tear strip in each bottom flap that is co-extensive with the tear strip in the other bottom flap;

(d) said top panel having a fold line that extends from one top end flap to the other top end flap, with a tear line extending through each top end flap, with said side end flaps on each end of the carton meeting in an area that is at least in the proximity of a plane that extends through the co-extensive tear strip in said bottom panel, and said fold line in said top panel, and (e) said carton being capable of being converted into a tray for holding said containers on one side panel, said tray having a hinged lid, said tray being formed by tearing said co-extensive tear strip which results in one bottom flap, and the bottom end flaps foldably attached to said one bottom flap and the one side panel foldably attached to said one bottom end flap and the side end flaps foldably attached to said one side panel and the portion of the top panel between said one side panel and said fold line in the top panel, with said lid being formed by the remaining flaps and panels of said carton, said lid being hinged by said fold line in said top panel.

2. The carton of claim 1, in which the means for securing said bottom flaps together and said side end flaps to said bottom and top end flaps together is glue.

3. The carton of claim 1, in which said co-extensive tear strip in said bottom panel of the carton is provided with a tear line in each bottom flap that is adjacent to the edge of the other bottom flap of the carton.

4. The carton of claim 1, in which the side end flaps on each end of the carton at least approximately abut each other.

5. The carton of claim 1, in which a tear line is provided in the bottom end flaps that is an extension of said tear line in at least one of the adjoining bottom flaps.

6. The carton of claim 1, which further has a tear line that extends from one end of the carton through one top end flap and extends at an angle towards the interior of the carton to a fold line between said top panel and adjoining side panel, said fold line being interspersed with cuts in its extension towards the other end of the carton, said tear line turning and extending at an angle towards the other end of the carton and extending through the adjoining top end flap so that when said tear line is torn opened, at least a portion of said adjoining side panel and top panel form a lid that can be opened and torn from the carton.

7. The carton of claim 1, which further has a carrying handle in the top panel.

8. The carton of claim 7, in which said carrying handle has a length at least substantially perpendicular to each side panel and is formed by a tear line separating two cushioning flaps attached to the top panel by fold lines.

9. The carton of claim 8, in which said tear line separating the two cushioning flaps extends a short distance into each side panel to dissipate the stress imposed on the carton in carrying the carton loaded with containers by the handle.

10. The carton of claim 9, in which said top panel has stress lines spaced around said carrying handle and which may extend into the side panels for further dissipating the stress imposed on the carton in carrying the carton loaded with containers by the handle.

11. The carton of claim 1, which further has at least one aperture which is formed between the lines extending through said tear lines, forming said co-extensive tear strip to facilitate the commencement of tearing the co-extensive tear strip.

12. The carton of claim 11, in which the means for securing said bottom flaps together and said side end flaps to said bottom and top end flaps together is glue.

13. The carton of claim 1, in which the tear line in each bottom flap is adjacent to the edge of the other bottom flap.

14. The carton of claim 1, in which said fold line in said top panel is located at least approximately equidistance from each side panel.

15. The carton of claim 14, in which the tray formed by tearing said co-extensive tear strip open has a guide flap attached to at least one bottom end flap that forms a part of the tray, said guide flap extending above the tear line in said bottom flap to which it is attached to provide a guide to facilitate closing the lid on the carton and assisting in holding the lid in the closed position.

16. The carton of claim 15, in which there is a guide flap attached to each bottom end flap that forms part of the tray.

17. The carton of claim 1 in which:

(a) each top end flap is foldably attached to said top panel via a pair of triangular panels that are at least of substantially the same size and configuration with each triangular panel diverging away from a corner formed by the intersection of said top panel, adjacent top end flap and an adjacent side panel, with said pair of triangular panels meeting each other at a location that is at least near the location of greatest divergence of each triangular panel, with said fold line in said top panel extending through at least one of each pair of triangular panels at a location that is at least near the location of the greatest divergence of each triangular panel; and (b) with each bottom end flap foldably attached to said bottom panel via a pair of triangular panels that are at least of substantially the same size and configuration with each triangular panel diverging away from a corner formed by the intersection of said bottom panel, adjacent bottom end flap and adjacent side panel with said pair of triangular panels meeting each other at a location that is at least near the location of the greatest divergence of each triangular panel, with said tear strips in said bottom panel extending through at least one of each pair of triangular panels adjoining a bottom end flap.

18. The carton of claim 17, in which each pair of triangular panels is of the same size and configuration and the fold line in said top panel extends through each pair of triangular panels at the location of the greatest divergence of each triangular panel from said adjacent corner.

19. The carton of claim 17, in which the means for securing said bottom flaps together and said side end flaps to said bottom and top end flaps together is glue.

20. The carton of claim 17, in which a tear strip is provided in each bottom end flap that is an extension of the tear strip in the adjoining triangular panel.

21. The carton of claim 17, in which a line with cuts extends from said fold line in said top panel in through each pair of adjoining triangular panels and adjoining top end flap to facilitate opening or tearing the lid off the carton in forming a tray.

22. The carton of claim 21, in which said fold line in said top panel, pair of triangular panels and top end flaps is interspersed with cuts so the lid may be torn off the carton.

23. The carton of claim 17, which further has a carrying handle in the top panel.

24. The carton of claim 23, in which said carrying handle has a length at least substantially perpendicular to each side panel and is formed by a tear line separating two cushioning flaps attached to the top panel by fold lines.

25. The carton of claim 24, in which said tear line separating the two foldable flaps for forming the carrying handle extends a short distance into each side panel to dissipate the stress imposed on the carton in carrying the carton loaded with containers by the handle.

26. The carton of claim 17, which further has at least one aperture which is between the lines extending through said tear lines for forming said tear strips to facilitate the commencement of tearing the tear strip.

27. The carton of claim 17, which further has a tear line that extends from one end of the carton through one top end flap and adjoining pair of triangular panels and extends at an angle towards the interior of the carton to a fold line between said top panel and adjoining side panel, said fold line being interspersed with cuts in its extension towards the other end of the carton, said tear line turning and extending at an angle towards the other end of the carton and extending through the adjoining pair of triangular panels and adjoining top end flap so that when said tear line is torn open, at least a portion of said adjoining side panel and top panel form a lid that can be opened and torn from the carton.

28. The carton of claim 17, which further has at least one aperture which is formed between the lines extending through said tear lines forming said co-extensive tear strip to facilitate the commencing of the tearing of the co-extensive tear strip.

29. The carton of claim 17, in which said tear strip in said bottom panel extends through at least one of said pair of triangular panels and adjoining bottom end flap and into a side end flap in which a aperture is located between said tear lines to facilitate opening said co-extensive tear strip.

30. The carton of claim 29, in which said tear strip in said bottom panel also extends through at least one of said pair of triangular panels on the other side of the carton and adjoining bottom end flap and for a distance into said adjoining side end flap that is approximately equal to the distance said tear strip extends through said adjoining bottom end flap.

* * * * *